US006263885B1

(12) United States Patent
Levy

(10) Patent No.: US 6,263,885 B1
(45) Date of Patent: Jul. 24, 2001

(54) FASHION ACCESSORY WITH CLOSABLE POUCH

(75) Inventor: Davida Levy, Surfside, FL (US)

(73) Assignee: Davida Enterprises, Inc., Sunny Isles, FL (US)

( * ) Notice: Subject to any disclaimer, the term of this patent is extended or adjusted under 35 U.S.C. 154(b) by 0 days.

(21) Appl. No.: 09/605,648

(22) Filed: Jun. 28, 2000

(51) Int. Cl.[7] ..... A45D 8/12; A45C 3/14

(52) U.S. Cl. ..... 132/275; 132/273; 224/219; 2/DIG. 11

(58) Field of Search ..... 132/273, 275; 224/219, 222, 267, 181; 2/170, DIG. 11, 174

(56) References Cited

U.S. PATENT DOCUMENTS

| | | | | |
|---|---|---|---|---|
| D. 158,103 | | 4/1950 | Kuenstner . | |
| D. 292,030 | | 9/1987 | Revson . | |
| D. 315,036 | | 2/1991 | Leopold . | |
| D. 315,226 | | 3/1991 | Revson . | |
| D. 336,544 | | 6/1993 | Maturaporn . | |
| D. 348,331 | | 6/1994 | Marrese . | |
| D. 355,974 | | 2/1995 | Jahn . | |
| D. 356,887 | | 4/1995 | Revson . | |
| D. 362,738 | | 9/1995 | Marrese . | |
| 1,070,250 | * | 8/1913 | Hamburger | 224/222 |
| 2,604,629 | | 7/1952 | Kennedy . | |
| 4,244,499 | * | 1/1981 | Adams | 224/222 |
| 4,462,116 | | 7/1984 | Sanzone . | |
| 5,141,141 | * | 8/1992 | Leone | 224/222 |
| 5,239,705 | | 8/1993 | Leopold . | |
| 5,301,696 | | 4/1994 | Revson . | |
| 5,305,470 | * | 4/1994 | McKay | 2/171 |
| 5,413,126 | * | 5/1995 | Revson | 132/275 |
| 6,105,837 | * | 8/2000 | Teed | 132/273 |

* cited by examiner

*Primary Examiner*—Todd E. Manahan
(74) *Attorney, Agent, or Firm*—Pillsbury Winthrop LLP

(57) ABSTRACT

A fashion accessory includes a band of elastic material defining a central opening forming an inner perimeter and fabric surrounding the band. The fabric is shaped so that the fashion accessory has a circular outer perimeter or has an outer perimeter having a plurality of substantially linear sides forming a triangle, square, pentagon, hexagon, septagon or octagon. A pouch for containing small items is formed in the fabric, the pouch being closable by a fastener extending along at least part of the outer perimeter or across from the inner perimeter to the outer perimeter. The fashion accessory may be used as a ponytail holder, headband, wrist band or ankle band or it may be attached to a belt or bag.

9 Claims, 2 Drawing Sheets

FASHION ACCESSORY WITH CLOSABLE POUCH

FIELD OF THE INVENTION

The invention relates to a fashion accessory, such as a ponytail holder, head band, wrist band or ankle band, having a closable pouch as part of the structure thereof.

BACKGROUND OF THE INVENTION

Ponytail holders and other hair accessories are well known in the art, as are wrist bands and ankle bands. Wearers of these fashion accessories may need a place to secure money, particularly coins, or a key. Known items of this kind do not generally have the capability of holding small items. Such capability is particularly useful for runners or others engaging in sports, and may also be useful in general for people wearing garments without pockets and for children.

Known prior art includes U.S. Design Pat. No. 292,030, which does not provide a pouch or purse for containing articles, and U.S. Pat. No. 5,413,126, which describes a pony tail holder in which a purse is provided in a wide portion of the pony tail holder, and a narrow portion is provided for winding around the hair. This fashion accessory is more costly to make than that of the invention and has the disadvantage that the purse portion is rather bulky.

SUMMARY OF THE INVENTION

A fashion accessory of the invention is a hair band, ponytail holder, wrist band or ankle band that provides a secure pouch for holding small items such as coins or keys. The invention includes a band of elastic material defining an inner perimeter and forming a central opening, fabric surrounding the band, the fabric being formed into a shape so that the fashion accessory has a circular outer perimeter or has a perimeter having a plurality of substantially linear sides forming a triangle, square, pentagon, hexagon, septagon or octagon, and a secure closure for a pouch formed in the fabric. The pouch is used for containing small items and has an opening that is closable by a fastener extending along at least part of the outer perimeter of the fashion accessory or extending across from the inner perimeter to the outer perimeter. Seams through the fabric define the extent of the pouch. The fasteners may be zip fasteners, or the opening may be closed by a substantially concealed fastening such as hook and loop fasteners (VELCRO®), hook and eye fasteners, magnetic fasteners, non-magnetic snap fasteners or buttons, arranged to securely close the opening of the pouch. Other types of fastener may, likewise, be used.

The seams defining the extent of the pouch extend from each end of the fastener to form a small purse or pouch in the fabric for containing small items. The bonding lines may be rows of stitching or heat bonding, as appropriate.

The fashion accessory may be used, in non-limiting examples as a ponytail holder, head band, wrist band or ankle band. It may also be attached to a belt, bag or backpack. A known fabric, for example, cotton, polyester and/or rayon, may be used.

DETAILED DESCRIPTION OF THE PREFERRED EMBODIMENTS

The fashion accessory described and illustrated is preferably used as a ponytail holder. It may also be used as a wrist band or an ankle band or as an attachment to a belt, bag or backpack. The item provides a secure, closable pouch or purse for holding objects such as coins, keys and/or personal identification, while exercising or engaging in any other activity where the user's clothes may not have appropriate pockets or where it is preferred not to carry a purse.

Figure 1A:
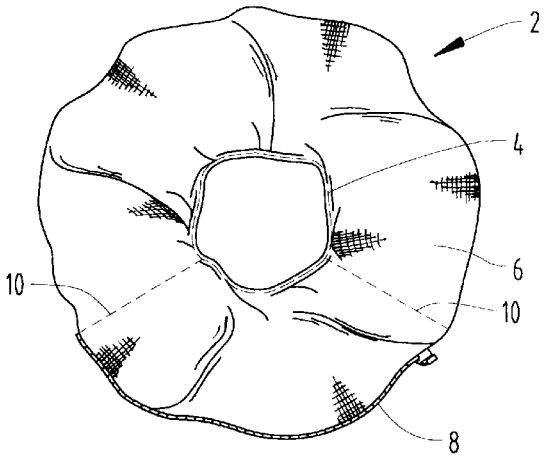
FIG. 1A is a top plan view of a circular fashion accessory of the invention, closed by a zip fastener extending in an outer perimeter thereof.
Figure 1B:
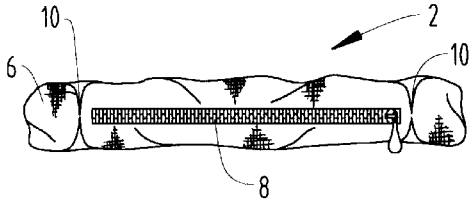
FIG. 1B is a side elevation view of the invention of FIG. 1A.

FIGS. 1A and 1 B illustrate fashion accessory 2 of the invention, which includes a concealed elastic band 4, surrounded by fabric 6. Fabric 6 is an elongated strip of material, having the ends joined together to form a circle. The outer edges of the strip are then joined together along a major portion of the length thereof with the elastic band 4 enclosed therebetween. The outer edges are not joined together over a minor portion of the length thereof, which minor portion is the length of zip fastener 8. Zip fastener 8 is inserted in the opening formed by the minor portion between the outer edges of the strip so that the edges are joined around the entire perimeter of the strip when the zip fastener is closed. The zip fastener may be a visible zip fastener or may be a zip fastener of the type that is concealed in use. Lines of stitching or heat bonding 10 are added to form a purse or pouch that may be opened or closed by the zip fastener.

Figure 2:
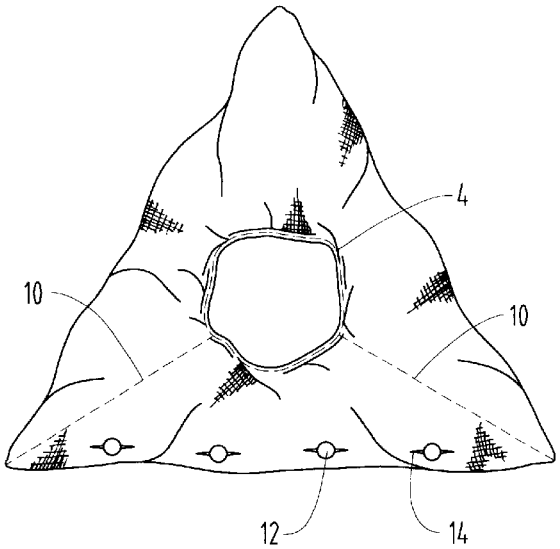
FIG. 2 is a top plan view of a triangular fashion accessory of the invention, closed by buttons.
Figure 3:
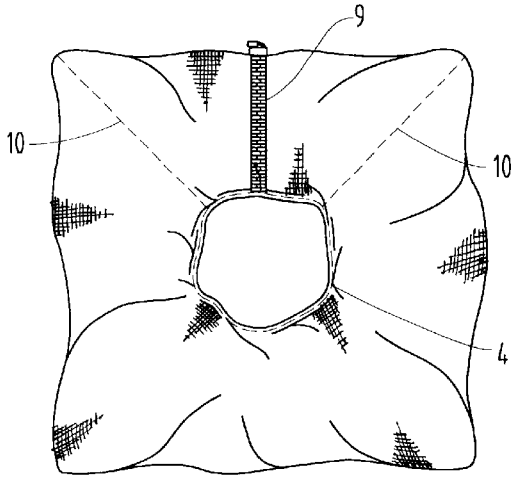
FIG. 3 is a top plan view of a square fashion accessory of the invention, closed by a zip fastener extending across from an inner perimeter to an outer perimeter thereof.
Figure 4:
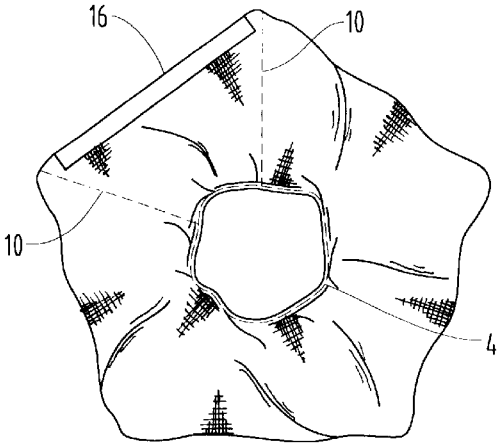
FIG. 4 is a top plan view of a pentagonal fashion accessory of the invention having an opening closed by concealed fasteners (not shown).
Figure 5:
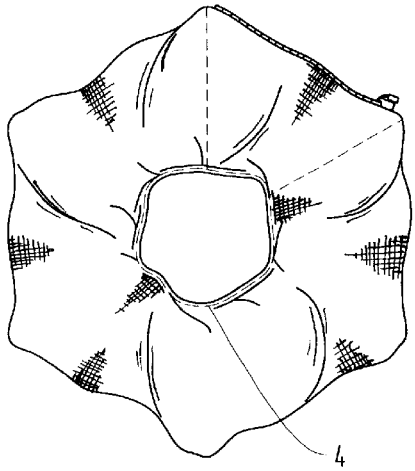
FIG. 5 is a top plan view of a hexagonal fashion accessory of the invention.
Figure 6:
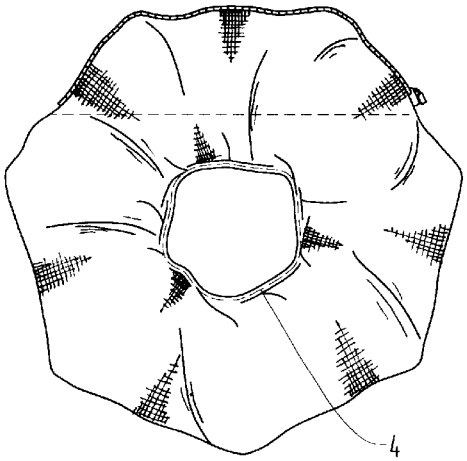
FIG. 6 is a septagonal fashion accessory of the invention.
Figure 7:
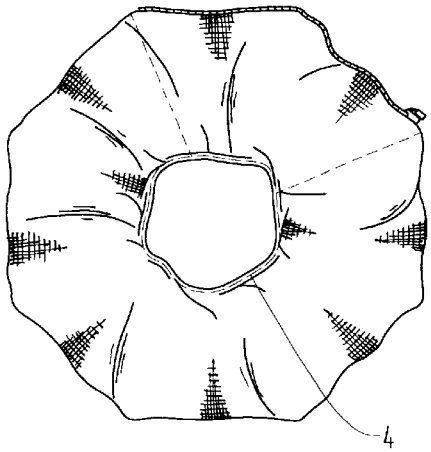
FIG. 7 is a top plan view of an octagonal fashion accessory of the invention.

FIGS. 2 to 7 show further embodiments of the invention in which the fabric is shaped to form a triangle, square, pentagon, hexagon, septagon or octagon. The closure extends along one of the straight sides, as shown in FIGS. 2, 4 and 5 or may extend along two or more sides, as shown in FIGS. 6 and 7.

FIG. 2 shows a triangular fashion accessory of the invention in which the pouch is closed by buttons. Buttons 12 are sewn onto the outside of one side and buttonholes 14 are formed in the corresponding side so that the pouch, defined at its sides by stitching lines 10, may be opened or closed using the buttons and buttonholes.

FIG. 3 shows a square fashion accessory having a zip fastener 9 extending across substantially from the inner perimeter to the outer perimeter, closing a pouch formed by lines of stitching 10, similar to the stitching lines shown in FIG. 1. Other closures, described below, may be positioned similarly to zip fastener 9, for closing the fashion accessory.

FIG. 4 shows a pentagonal fashion accessory of the invention. The edges have a concealed fastening 16, shown in FIG. 4, where the opening is closable using concealed hook and loop fasteners (such as VELCRO®), hook and eye fasteners, magnetic snap fasteners or non-magnetic snap fasteners secured along the inside edges, as is known in the art. The fasteners are substantially concealed in use, and the edges are closed upon being pressed together, to form a securely closed pouch.

FIG. 5 shows a hexagonal item, FIG. 6 shows a septagonal item and FIG. 7 shows an octagonal item of the invention.

The shape of the strip of fabric used for the embodiments of FIGS. 2 to 7 will be apparent to one skilled in the art. The edges of the elongated strip will be zigzagged according to the number of corners in the fashion accessory so that, for example, the strip of fabric used for forming a square item, having four corners, as shown in FIG. 3, will have four triangular peaks along each side of the fabric strip, positioned opposite each other. When the strip is folded over the elastic band, the opposite peaks will lie on top of each other, for stitching together. The other shapes are made likewise. Further shapes will be apparent to one skilled in the art.

The closings for each embodiment shown in the Figures may be zip fasteners or any of the fasteners described and illustrated in FIGS. 2 and 4. The shape of the item, the size and manner of sealing the pouch and the length of the closing are selected according to the intended use, as will be apparent to one skilled in the art.

While the invention has been described with respect to certain embodiments thereof, it will be appreciated that variations and modifications may be made without departing from the spirit and scope of the invention.

What is claimed is:

1. A fashion accessory, comprising:

a band of elastic material substantially defining an inner perimeter and forming a central opening;

a fabric surrounding said band of elastic material, shaped so that the accessory has an out perimeter that has a plurality of substantially linear sides, wherein the accessory has an outer shape selected from the group consisting of a triangle, square, pentagon, hexagon, septagon or octagon;

a pouch for containing small items, formed in the fabric, the pouch comprising an opening and fastener means for closing the opening.

2. A fashion accessory according to claim 1, wherein the fastener means comprises a zip fastener.

3. A fashion accessory according to claim 1, wherein the fastener means is substantially concealed between layers of the fabric.

4. A fashion accessory according to claim 1, further comprising bonding lines extending from each end of the fastener means toward the elastic band to form the pouch for containing small items.

5. A fashion accessory according to claim 4, wherein the bonding lines comprise rows of stitching.

6. A fashion accessory according to claim 4, wherein the bonding lines comprise rows of heat sealing.

7. A fashion accessory according to claim 1, wherein the fastener means extends along at least part of one or more fabric seams of the fashion accessory.

8. A fashion accessory according to claim 1, wherein the fastener means extends along a part of the outer perimeter.

9. A fashion accessory according to claim 1, wherein the fastener means extends across the accessory, substantially from the inner perimeter to the outer perimeter.

* * * * *